US005752492A

United States Patent [19]

Kato et al.

[11] Patent Number: 5,752,492

[45] Date of Patent: May 19, 1998

[54] APPARATUS FOR CONTROLLING THE AIR-FUEL RATIO IN AN INTERNAL COMBUSTION ENGINE

[75] Inventors: Yoshihiko Kato; Masahiro Wanibe, both of Susono, Japan

[73] Assignee: Toyota Jidosha Kabushiki Kaisha, Aichi, Japan

[21] Appl. No.: 878,326

[22] Filed: Jun. 18, 1997

[30] Foreign Application Priority Data

Jun. 20, 1996 [JP] Japan ..... 8-159624

[51] Int. Cl.[6] ..... F02D 41/00

[52] U.S. Cl. ..... 123/674

[58] Field of Search ..... 123/674, 675, 123/698, 691, 684; 364/431.05, 431.052, 432–12; 60/276

[56] References Cited

U.S. PATENT DOCUMENTS 5,638,801 6/1997 Maki et al. ..... 123/674
5,687,699 11/1997 Shimada et al. ..... 123/673
5,690,086 11/1997 Kawano et al. ..... 123/674
5,694,910 12/1997 Hasegawa ..... 123/674

FOREIGN PATENT DOCUMENTS 59-203828 11/1984 Japan ..... 123/674
60-45743 3/1985 Japan ..... 123/674
7-197837 8/1995 Japan ..... 123/674

*Primary Examiner*—Raymond A. Nelli
*Attorney, Agent, or Firm*—Kenyon & Kenyon

[57] ABSTRACT

An apparatus for controlling the air-fuel ratio in an internal combustion engine, which quickly responds to a deviation between the actual air-fuel ratio and the target air-fuel ratio in the engine and results in immediate purification of the exhaust gas discharged from the engine.

7 Claims, 13 Drawing Sheets

APPARATUS FOR CONTROLLING THE AIR-FUEL RATIO IN AN INTERNAL COMBUSTION ENGINE

BACKGROUND OF THE INVENTION

1. Field of the Invention

The present invention relates to an apparatus for controlling the air-fuel ratio in an internal combustion engine, and more particularly, to an apparatus for the same which learns a deviation between the actual fuel supply amount and the target fuel supply amount to the engine in response to the engine operating condition with the use of the output of an air-fuel ratio sensor provided in the exhaust system of the engine, the deviation occurring due to the deterioration with the age in the fuel supply system of the engine, and reflects a deviation in the subsequent fuel supply amount.

2. Description of the Related Art

The apparatus for controlling the air-fuel ratio in an internal combustion engine, in general, comprises an air-fuel ratio sensor in the exhaust system of the engine, in which the air-fuel ratio sensor detects the air-fuel ratio, namely, the ratio of an intake air amount to a fuel supply amount in the mixture supplied to the cylinder of the engine. The apparatus is controlled to supply the fuel injection amount to the engine to maintain the target air-fuel ratio, for example, the stoichiometric air-fuel ratio, in response to the engine operating conditions.

The output of the air-fuel ratio sensor changes when the mixture in the cylinder is around the stoichiometric air-fuel ratio, which is called a Z characteristic. The output turns from rich state to lean state or vice versa wherein the rich state indicates that the air-fuel ratio of the mixture is smaller than the stoichiometric air-fuel ratio, and the lean state indicates that the air-fuel ratio of the mixture is larger than the stoichiometric air-fuel ratio.

The apparatus controls the air-fuel ratio in the engine to maintain the target air-fuel ratio by correcting the fuel supply amount (TAU) calculated by the following equation, $$TAU=\alpha TP\ (FAF+FG)$$

wherein TP indicates the basic fuel injection amount, FAF indicates the air-fuel ratio correction factor, FG indicates the air-fuel ratio learned correcting factor and $\alpha$ indicates the other factors. In a known technique, FAF is corrected based on three parameters such as a proportional factor, an integral factor and a delay time factor. The proportional factor may be a determined value and is added to FAF when the air-fuel ratio of the mixture turns the state from rich to lean, while the factor is subtracted from FAF when the air-fuel ratio of the mixture turns the state from lean to rich. The integral factor gradually increases FAF when the mixture is in lean state and gradually decreases FAF when the mixture is rich state. The delay time factor is provided to delay the start of the integration for the integral factor after the mixture state is turned from rich to lean or lean to rich. The delay time factor may be respectively set in response to the above mixture state change from rich to lean or lean to rich.

The air-fuel ratio learned correction factor FG is provided for correcting the deviation between the actual air-fuel ratio and the target air-fuel ratio, caused by differences between engines or the age-related deterioration in the engine. The deviation occurs when the air-fuel ratio feedback control is not executed. In this case, FG is learned and calculated from the average air-fuel ratio correction factor FAFAV when the air-fuel ratio feedback control is not executed. For example, if the average FAFAV>1.005, FG=FG+0.002 is calculated, if $0.995 \leqq FAFAV \leqq 1.005$, FG=FG, namely, no calculation is made, and if FAFAV<0.995, FG=FG−0.002 is calculated.

The Japanese Patent Publication No. 60-45743 discloses the above technique of the air-fuel ratio learning control, and further discloses that FG is respectively provided corresponding to each section (domain) divided into a plurality of sections in the operating condition of the engine, that FG is calculated from the average of the air-fuel ratio correction factor FAF, and that FG is used for calculating TAU even though the engine is in transitional driving conditions such as accelerating and decelerating time, thereby improving the response in the air-fuel ratio feedback control even under the transitional driving conditions.

The apparatus disclosed in the Japanese Patent Publication No. 60-45743 comprises the air-fuel ratio learned correction factor FG updated corresponding to each domain in the engine operating condition, however, FAF necessary for calculating FG does not correspond to the above each domain, in other words, FAF is influenced by the previous engine operating condition corresponding to the previous domain different from the current domain in the engine operating condition. Therefore, the air-fuel ratio learned correction factor FG cannot be accurately calculated corresponding to each domain in the engine operating condition, resulting in controlling the air-fuel ratio with a large deviation from the target air-fuel ratio, thus the apparatus fails to purify the exhaust gas discharged from the engine.

SUMMARY OF THE INVENTION

The present invention has been made in view of the foregoing problems and it is therefore an object of the present invention to provide an apparatus for controlling the air-fuel ratio in an internal combustion engine which accurately corrects the air-fuel ratio learned correction factor FG corresponding to each domain in the engine operating condition, calculates a proper fuel injection amount to be supplied to the engine so that the air-fuel ratio in the engine detected by the air-fuel ratio sensor becomes a target air-fuel ratio and supplies the calculated fuel injection amount to the engine, thereby the exhaust gas discharged from the engine is best purified.

A further object of the present invention is to increase the speed of learning the air-fuel ratio learned correction factor FG, thereby the air-fuel ratio in the engine is controlled to quickly reach to the target air-fuel ratio.

FIG. 1 is block diagram showing a basic constitution of an apparatus for controlling the air-fuel ratio in an internal combustion engine according to a first aspect of the present invention.

In order to accomplish the above object of the invention, the apparatus for controlling the air-fuel ratio in an internal combustion engine comprises: a linear type air-fuel ratio sensor 11 provided in the exhaust system of the engine 10; a means 13 for calculating a target fuel supply amount fim in response to the engine operating condition, the target fuel supply amount being predetermined so that the air-fuel ratio of the mixture supplied to the engine 10 becomes a target air-fuel ratio; a means 12 for correcting learned values, each corresponding to each domain divided into a plurality of sections of the engine operating condition, based on a deviation between an actual air-fuel ratio VAIF calculated from the output of the air-fuel ratio sensor 11 and the target air-fuel ratio $V_{A/FS}$; and a means 15 for calculating a fuel supply amount fi to the engine 10 based on the target fuel supply amount and the learned value respectively calculated by the above means and a feedback correction amount calculated in response to the deviation.

FIG. 2 is a block diagram the same as FIG. 1 except that FIG. 2 further shows a detailed constitution of the means 12 for correcting learned values.

In the apparatus according to the first aspect of the invention, a means 12 for correcting learned values comprises: a means 16 for calculating integral values each obtained by integrating a deviation between an actual air-fuel ratio calculated from the output of the air-fuel ratio sensor and the target air-fuel ratio, each integral value being corresponding to each domain divided into a plurality of sections of the engine operating condition; a storage 17 for storing learned values corresponding to the integral values of the deviations each obtained corresponding to each domain of the engine operating condition; and a means 18 for updating the learned values stored in the storage corresponding to the integral values calculated by the integral value calculating means 16.

The means 12 for correcting learned values shown in FIG. 2 further comprises a means 19 for changing a correcting amount of the learned value in response to the integrated value.

The means 13 for calculating a target fuel supply amount calculates the target fuel supply amount so that the air-fuel ratio in the engine becomes the target air-fuel ratio previously set in response to the engine operating conditions such as an intake air amount, coolant water temperature and the like. The operating conditions are divided into a plurality of sections. The means 16 for calculating integral values integrates the deviation between the actual air-fuel ratio $V_{A/F}$ obtained from the output of the linear type air-fuel ratio sensor 11 and the target air-fuel ratio $V_{A/FS}$ to each domain divided into the sections, and calculates the integral values. The storage 17 stores the learned values corresponding to the domains in the operating condition. The means 18 for updating the learned values updates the leaned value corresponding to each domain based on the integral value in the domain. The fuel supply amount fi is calculated based on the learned integral value by the means 15 for calculating a fuel supply amount.

The speed of learning the integral value can be increased by changing the correcting amount of the learned value in response to the integrated value by the means 19 for changing a correcting amount of the learned value.

In the apparatus for controlling the air-fuel ratio explained above, the feedback correction amount is changed, even though the integral value is the same, if the load correction factor ekld is changed to a desired value in response to a P gain, an I gain and a D gain in PID control or the engine load conditions. This is because the learned correction factor is updated in response to the integral value by the apparatus. This means that the learned correction factor is updated with the same amount although the feedback correction amounts are different, namely, the same amount of correction is executed whenever the learned correction factor is updated in response to the different feedback correction amount although the learning control should update the learned correction factor so that the air-fuel ratio in the engine can quickly reach to the target air-fuel ratio when the deviation between the current air-fuel ratio and the target air-fuel ratio is large.

In addition to the point mentioned above, the apparatus updates the learned correction factor based on the integral value only when the integral value being integrated during the engine is running exceeds a threshold level of the integral value, but the learned correction factor is not updated when the integral value does not exceed the threshold level. However, the feedback correction amount Afi is changed whenever each gain, P, I or D, or the load correction factor ekld is changed to a desired value, thus the threshold of the feedback correction amount corresponding to the threshold value of the integrated value changes when the gain or the load correction factor ekld is changed.

If the threshold level of the feedback correcting amount is changed to be increased, namely, if the feedback gain of the apparatus for controlling the air-fuel ratio is changed to be decreased, the learned correction factor may not be updated when the factor is to be updated. This causes a delay in the air-fuel ratio feedback control, namely, the time for the air-fuel ratio in the engine to reach to the target air-fuel ratio becomes long, and the exhaust gas discharged from the engine cannot be well purified for this period. On the other hand, if the threshold level of the feedback correcting amount is changed to be decreased, namely, if the feedback gain of the apparatus for controlling the air-fuel ratio is changed to be increased, the learned correction factor is over-updated, namely, the learned correction factor is updated when the factor should not be updated, for example, when a noise or a disturbance occurs. This may initiate hunting in the air-fuel ratio feedback control.

To avoid the above mentioned situations, the following apparatus is provided, which updates the learned correction factor corresponding to the feedback correcting amount and does not change the threshold level even though each gain such as P, I or D, or the load correction factor is changed and, thereby, a better air-fuel ratio control can be realized.

FIG. 3 is a block diagram the same as FIG. 1 except that FIG. 3 further shows another detailed constitution of the means for correcting learned values 12.

In the apparatus according to the first aspect of the invention, another means 12 for correcting learned values is provided which comprises: a means 12*a* for calculating a feedback correcting amount based on a deviation between the actual air-fuel ratio calculated from the output of the air-fuel ratio sensor and the target air-fuel ratio; a means 12*b* for calculating a feedback correcting rate of the target fuel amount to the feedback correcting amount; and a means 12*c* for updating a learned correction factor based on the comparison of the feedback correcting rate and a threshold level of the rate.

The means 12 for correcting learned values shown in FIG. 3 further comprises a means 12*b* for changing a correcting amount of the learned value in response to the integrated value.

According to the apparatus for controlling the air-fuel ratio of the present invention, the learned correction factor can be updated corresponding to the feedback correction amount since the feedback correction rate dfirt calculated as a ratio of the feedback correction amount Δfi to the target fuel supply amount fim is used as the parameter, thereby a very precise air-fuel ratio learning control can be realized.

Furthermore, since the feedback correction rate dfirt is used as a parameter and the learned correction factor FKG is updated when the rate dfirt exceeds a threshold level, the learned correction factor FKG can be updated when the rate dfirt exceeds the same threshold level in spite of changing the load correction factor ekld that corrects the feedback amount Δfi in response to the P (proportional) gain, the I (integral) gain or the engine load for determining the feedback correction amount Δfi. As a result, a delay in purifying the exhaust gas of the engine and the occurrence of the hunting in the air-fuel ratio feedback control can be avoided.

FIG. 4 is block diagram showing a basic constitution of an apparatus for controlling the air-fuel ratio in an internal combustion engine according to a second aspect of the present invention. The air-fuel ratio control based on the modern control technology with the use of PI (proportional and integral) factors of the linear type air-fuel ratio sensor output and the learning control based on the integral value of deviation in the fuel supply amount to the engine are applied to the apparatus of the second aspect of the present invention.

In order to accomplish the above object of the invention, the apparatus for controlling the air-fuel ratio in an internal combustion engine 210 comprises:

- a linear type air-fuel ratio sensor 211 provided in the exhaust system of the engine 210;
- a means 213 for calculating a target fuel supply amount in response to the engine operating condition, the target fuel supply amount being predetermined so that the air-fuel ratio of the mixture supplied to the engine becomes a target air-fuel ratio;
- a means 212 for correcting learned values, each corresponding to each domain divided into a plurality of sections of the engine operating condition, based on a deviation between an actual fuel supply amount calculated from the output of the air-fuel ratio sensor and the target fuel supply amount; and
- a means 215 for calculating a fuel supply amount to the engine based on the target fuel supply amount and the learned value respectively calculated by the above means and a feedback correction amount calculated in response to the deviation.

FIG. 5 is block diagram the same as FIG. 4 except that FIG. 5 further shows a detailed constitution of the means 212 for correcting learned values.

In the apparatus according to the second aspect of the invention, a means 212 for correcting learned values comprises:

- a means 221 for calculating integral values each obtained by integrating a deviation between an actual fuel supply amount calculated from the output of the air-fuel ratio sensor and the target fuel supply amount, each integral value being corresponding to each domain divided into a plurality of sections of the engine operating condition;
- a storage 222 for storing learned values corresponding to the integral values of the deviations each obtained corresponding to each domain of the engine operating condition; and
- a means 223 for updating the learned values stored in the storage corresponding to the integral values calculated by the integral value calculating means.

Referring to FIGS. 4 and 5, the operations of the apparatus according to the second aspect of the invention will be explained below.

The apparatus detects the rotational speed NE of the engine 210 from a crank angle sensor (not shown), detects the intake air amount ma to a cylinder from an air flow meter (not shown) and detects the air-fuel ratio $\alpha$ of the mixture supplied to the engine 210 from the output of an air-fuel ratio sensor 211. An intake air amount estimate means 216 is provided to estimate the intake air amount mc based on a two dimensional map of the intake air amount ma and the engine rotational speed NE. An actual fuel amount estimate means 218 is provided to estimate the actual fuel amount fc supplied to the cylinder from the air-fuel ratio $\alpha$ and the intake air amount mc. A target fuel amount setting means 217 is provided to set the target fuel amount fcr from the intake air amount mc and a target air-fuel ratio, for example, the stoichiometric air-fuel ratio. A subtraction 218 is provided to calculate (fc–fcr), the deviation between the estimated fuel amount fc and the target fuel amount fcr, wherein fc is estimated by the actual fuel amount estimate means 218. An integral value calculating means 221 is provided to calculate the integral value of the deviation (fc–fcr) corresponding to each domain divided into a plurality of sections in the engine operating conditions of the engine 210. A target fuel supply amount estimate means 213 is provided to estimate the target fuel supply amount fim based on the target fuel amount fcr. It is necessary to estimate fim by the target fuel supply amount estimate means 213 because of the reason below.

The fuel amount injected into the intake pipe and the fuel amount actually supplied into the cylinder are not always the same, therefore the fuel amount actually supplied into the cylinder has to be estimated from the fuel injection amount fi injected to the intake port, for example, based on a fuel depositing rate R representing a fuel rate of the fuel deposited on the wall in the intake pipe and a fuel remaining rate P representing a fuel rate of the fuel remained on the wall and not supplied into the cylinder.

A storage 222 is provided to store the learned values KG corresponding to the integral values of the deviation (fc–fcr), each learned value is provided corresponding to each domain in the engine operating condition. A learned value updating means 223 is provided to update the leaned value KG stored in the storage 222 in response to the integral value of the deviation (fc–fcr) calculated for each domain in the engine operating condition by the integral value calculating means 221.

A fuel supply amount calculating means 215 is provided to calculate the fuel supply amount fi to the engine based on the target fuel supply amount fim, the air-fuel ratio leaning correction factor FKG obtained from the storage 222 and the air-fuel ratio feedback correction amount Afi calculated by the integral value calculating means 221, will be explained later.

According to the air-fuel ratio feedback control based on the modern control explained above, the intake air amount into a cylinder per a revolution of the engine, mc, is calculated from the engine rotational speed NE and the output of the air flow meter and the air-fuel ratio $\alpha_{(i)}$ is calculated from the output $V_{A/F(i)}$ of the air-fuel ratio sensor 211, then the actual fuel amount fc into the cylinder is calculated from mc and $\alpha$ by the equation $fc_{(i)}=mc/\alpha_{(i)}$. In the same way, the target fuel amount $fcr_{(i)}$ necessary for making the combustion air-fuel ratio the stoichiometric ratio is calculated by the equation $fcr_{(i)}=mc/\alpha r$. Then, the fuel supply amount $fi_{(i)}$ is determined so that both the deviation $(fc_{(i)}-fcr_{(i)})$ and the integral value $x1_{(i)}$ of the deviation may be simultaneously converged to 0. As previously explained, the fuel amount injected into the intake pipe and the fuel amount actually supplied into the cylinder are not always the same because a part of the injected fuel is deposited on the wall in the intake port, thus this deposited fuel amount is taken into consideration upon determining the fuel supply amount $fi_{(i)}$ according to the present invention. In this way, the three-way catalyst can continually store the determined amount of oxygen by controlling the fuel supply amount $fi_{(i)}$ so that both the deviation $(fc_{(i)}-fcr_{(i)})$ and the integral value $x1_{(i)}$ of the deviation may be simultaneously converged to 0, thereby quickening the response of the air-fuel ratio control.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

The preferred embodiments of the present invention will be described below with reference to the accompanying drawings.

Figure 6:
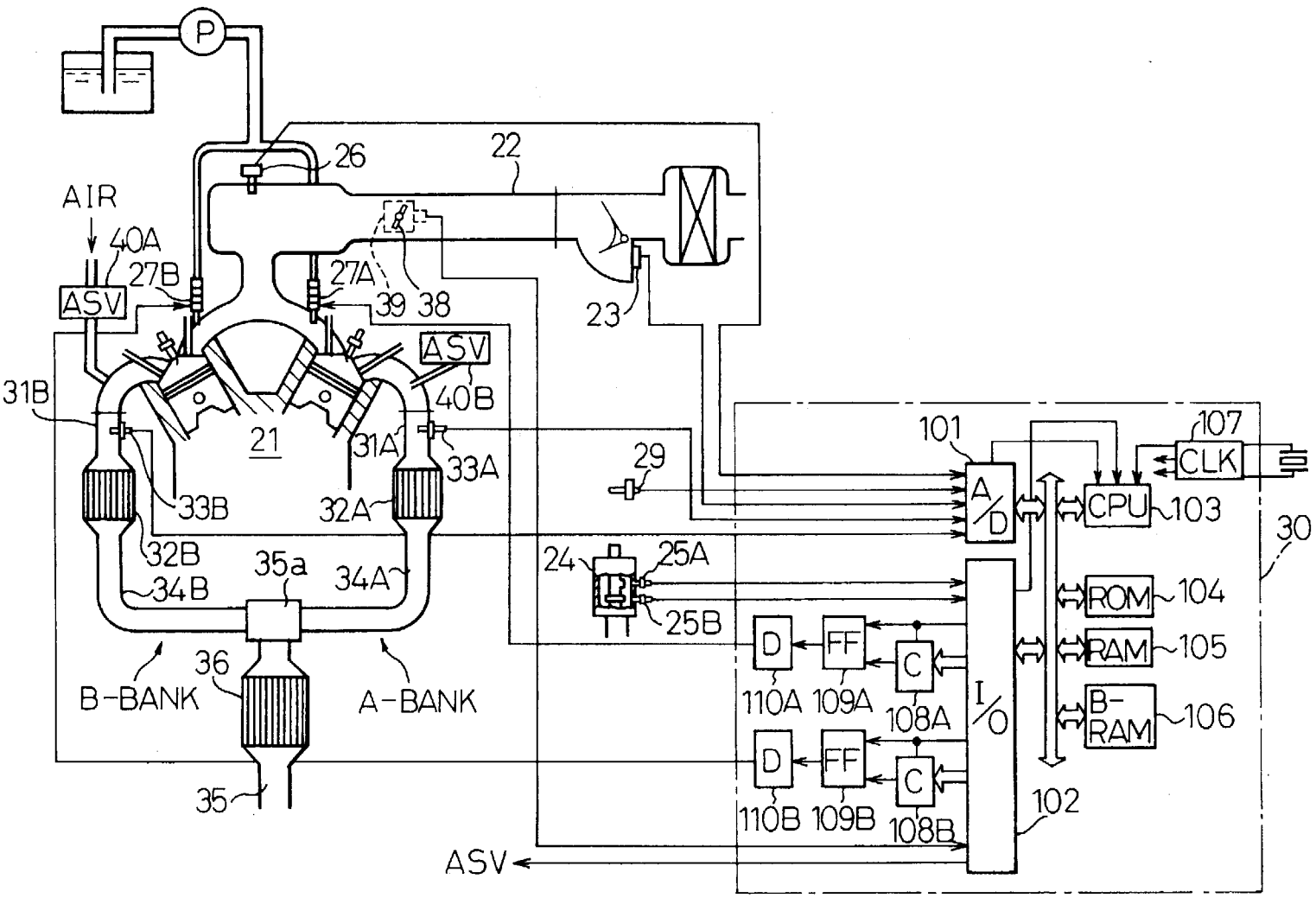
FIG. 6 is a schematic diagram showing an embodiment of the present invention.

FIG. 6 is a schematic diagram showing an embodiment of the present invention. In this embodiment, a v-six engine is used as shown in FIG. 6, however, the present invention can also be applied to other types of engines such as an in-line engine.

In FIG. 6, the reference number 21 indicates a block of a v-six engine in which three pairs of cylinders are arranged in two rows. An air flow meter 23 is provided in an intake passage 22 of the engine block 21. The air flow meter 23 directly measures the amount of intake air, for example, a movable vane type air flow meter equipped with a potentiometer is used. The air flow meter 23 outputs an analog voltage signal proportional to the intake air amount. This output signal is input to an A/D converter 101 incorporated with a multiplexer in a control circuit 30. Two crank angle sensors 25A and 25B are provided in a distributor. The sensor 25A generates a base crank angle signal each time 720 degrees in crank angle revolution is detected, while the sensor 25B generates a crank angle signal each time 30 degrees in crank angle revolution is detected. These crank angle sensor signals are input to an input/output interface 102 in the control circuit 30. The crank angle sensor signal of the sensor 25B is also input to an interrupt terminal of a CPU 103.

An intake air pressure sensor 26 is also provided in an intake passage 22 of the engine block 21. The intake air pressure sensor 26 outputs an analog voltage signal proportional to the intake air pressure in the passage 22. The signal is also input to the A/D converter 101.

Furthermore, fuel injection valves 27A and 27B are provided in the passage 22 to supply pressurized fuel to each intake port of each cylinder from a fuel supply system.

The engine cylinder block 21 is equipped with a water jacket (not shown) in which a coolant temperature sensor 29 is provided to detect coolant temperature. The sensor 29 outputs an analog voltage signal proportional to the coolant temperature. The signal is also input to the A/D converter 101.

Catalytic converters 32A and 32B are respectively provided in an exhaust system downstream of exhaust manifolds 31A and 32B each provided at a right bank (A) and a left bank (B) of the engine 21, each having three cylinders as a group. The catalytic converters 32A and 32B respectively contain a three-way catalyst that concurrently purifies three contaminant such as HC, CO and $NO_X$ in the exhaust gas from the engine. These converters 32A and 32B are relatively small and are provided in the engine compartment so that the warming up of the catalysts may be accomplished in a short time.

In the exhaust manifold 31A at the right bank (hereinafter referred to A bank), namely, upstream of the converter 32A in the exhaust pipe 34A, an air-fuel ratio sensor 33A is provided, while in the exhaust manifold 31B at the left bank (hereinafter referred to B bank), namely, upstream of the converter 32B in the exhaust pipe 34B, an air-fuel ratio sensor 33B is provided.

The exhaust pipes 34A and 34B are connected at a junction unit **35*a* on the downstream side. A converter (main catalyst) 36 containing a three-way catalyst is provided down stream of the junction unit 35*a* in an exhaust pipe 35 connected to the junction unit 35*a***. This converter is relatively large and mounted under the floor of the vehicle.

In the present embodiment, linear and full range output type sensors are used as air-fuel ratio sensors 33A and 33B. The air-fuel ratio sensors of this type generate an output voltage signal in wide range corresponding to the air-fuel ratio, substantially proportional to the oxygen concentration in the exhaust gas of the engine. The output signals of the air-fuel ratio sensors are input to the A/D converter 101 in the control circuit 30.

In the present embodiment, the control circuit 30 is, for example, made as a micro computer system having an A/D converter, an input-output interface 102, a CPU 103, a ROM 104, a RAM 105, a back-up RAM 106, a clock generator 107 and the like. The control circuit 30 is provided to perform basic functions such as fuel injection control, ignition timing control and the like. The control circuit 30 is also provided to perform the air-fuel ratio control according to the present invention. The target fuel supply amount calculating means 13, the learned value correcting means 12, the supply amount calculating means 15 and other means are performed as functions of the control circuit 30.

In the intake passage 22, a throttle valve 38 is provided which outputs a signal indicating a fully open state of the valve, namely, an idle switch 39 is provided to generate a XIDL signal. The XIDL signal is input to the input-output interface 102.

The reference numbers 40A and 40B are secondary air introducing intake valves that supply the secondary air to the exhaust manifolds 31A and 31B from an air source (not shown) such as an air pump to reduce HC and CO emissions in the exhaust gas during the engine decelerating or idling time.

Furthermore, a down counter 108A, a flipflop 109A and a drive circuit 110A are provided to control the fuel injection valve 27A in the control circuit 30, while a down counter 108B, a flipflop 109B and a drive circuit 110B are provided to control the fuel injection valve 27B in the control circuit 30.

The fuel injection valves 27A and 27B are controlled as follows. When the fuel injection time corresponding to the fuel injection amount $fi_{(A)}$ ($fi_{(B)}$) is calculated in accordance with a routine according to the present invention explained later, the fuel injection time $fi_{(A)}$ ($fi_{(B)}$) is set to the down counter 108A (108B) and at the same time the flipflop 109A (109B) is set. As a result, the control circuit 110A (110B) begins to be energized to open the fuel injection valve 27A (27B). Then, the down counter counts a clock signal (not shown) up to the set count and finally counts up to change the output to a high level and at the same time the flipflop 109A (109B) is reset to deenergize to close the fuel injection valve 27A (27B). in this way, the fuel injection valve 27A (27B) is energized for the fuel injection time corresponding to the fuel injection amount $fi_{(A)}$ ($fi_{(B)}$) and the same amount of fuel is supplied to a combustion chamber of the A (B) bank of the engine 21.

The interruption of the CPU 103 mainly occurs after the analog to digital conversion has been executed and when the crank angle sensor signal 25B is received by the input-output interface 102.

The intake air amount from the air flow meter 23, the intake air pressure from the intake air pressure sensor 26 and the coolant temperature from the coolant temperature sensor 29 are read by executing an A/D conversion routine every predetermined time or every predetermined degree in crank angle and these data are stored in an area of the RAM 105. In other words, the data such as the intake air amount, the intake air pressure and the coolant temperature are updated every predetermined time or every predetermined amount of crank angle. On the other hand, the rotational speed data of the engine is calculated every 30 degrees of crank angle rotation which is initiated by the interruption from the crank angle sensor 25A, and the rotational speed data is also stored in another area of the RAM 105.

Hereinafter, a first embodiment of an apparatus for controlling the air-fuel ratio in the engine based on P. I. D. control according to the present invention will be explained referring to FIGS. 2 and 6. In the first embodiment, the air-fuel ratio feedback control with the use of the conventional P. I. D. control in response to the linear type air-fuel ratio sensor output is adopted. The integral factor learning control is added to the air-fuel ratio feedback control according to the present invention. In other words, the integral factor related to the deviation between the current air-fuel ratio and the target air-fuel ratio, namely, the air-fuel ratio learning correction factor FG, is learned and added to the air-fuel ratio correction factor FAF to quickly control the air-fuel ratio in the engine.

In the control circuit 30 of the first embodiment, the air-fuel ratio feedback correcting amount $\Delta V_{A/F}$ for correcting the fuel injection amount is calculated from the deviation ($V_{A/F}-V_{A/FS}=\Delta V_{A/FS}$) between the output $V_{A/F}$ of the air-fuel ratio sensor 33A or 33B and a reference value $V_{A/FS}$ corresponding to the stoichiometric air-fuel ratio calculated from a map previously stored in the RAM 105 in response to the operating conditions of the engine 21, by the following equation, $$\Delta V_{A/F}=KP*\Delta V_{A/FS}+KI*SUM\ (V_{A/FS})+KD*d\ (V_{A/FS})$$

wherein KP indicates a constant proportional factor, KI indicates a constant integral factor, KD indicates a constant differential factor, SUM ($V_{A/FS}$) indicates an integral value ($\Sigma\Delta V_{A/FS}$) of the deviation $\Delta V_{A/FS}$ calculated by a method explained later and d ($V_{A/FS}$) indicates a differential value calculated by a method explained later, and KP, KI and KD are gain constants for the air-fuel ratio feedback which are experimentally determined.

As can be understood from the above equation, the air-fuel ratio feedback correcting amount $\Delta V_{A/F}$ is determined by the PID process based on the deviation $\Delta V_{A/FS}$ between the output $V_{A/F}$ of the air-fuel ratio sensor and a reference value $V_{A/FS}$ corresponding to the output of the air-fuel ratio sensor when the air-fuel ratio in the mixture of the engine is stoichiometric.

In the above equation, the proportional factor $KP*\Delta V_{A/FS}$ and the differential factor KD*d ($V_{A/FS}$) are provided to correct the transient deviation, while the integral factor KI*SUM ($V_{A/FS}$) is provided to correct the constant deviation in the air-fuel ratio, the constant deviation occurs, for example, due to the deterioration, with the age, of the reference output of the air-fuel ratio sensor.

Furthermore, the control circuit 30 converts from $\Delta V_{A/F}$ to $\Delta f_i$ and calculates the fuel injection amount $f_i$ by the following equation, $$f_i=f_{bn}+\Delta f_i$$

Next, a method for calculating the integral value ($\Sigma\Delta V_{A/FS}$) of the deviation $\Delta V_{A/FS}$ will be explained.

Figure 1:
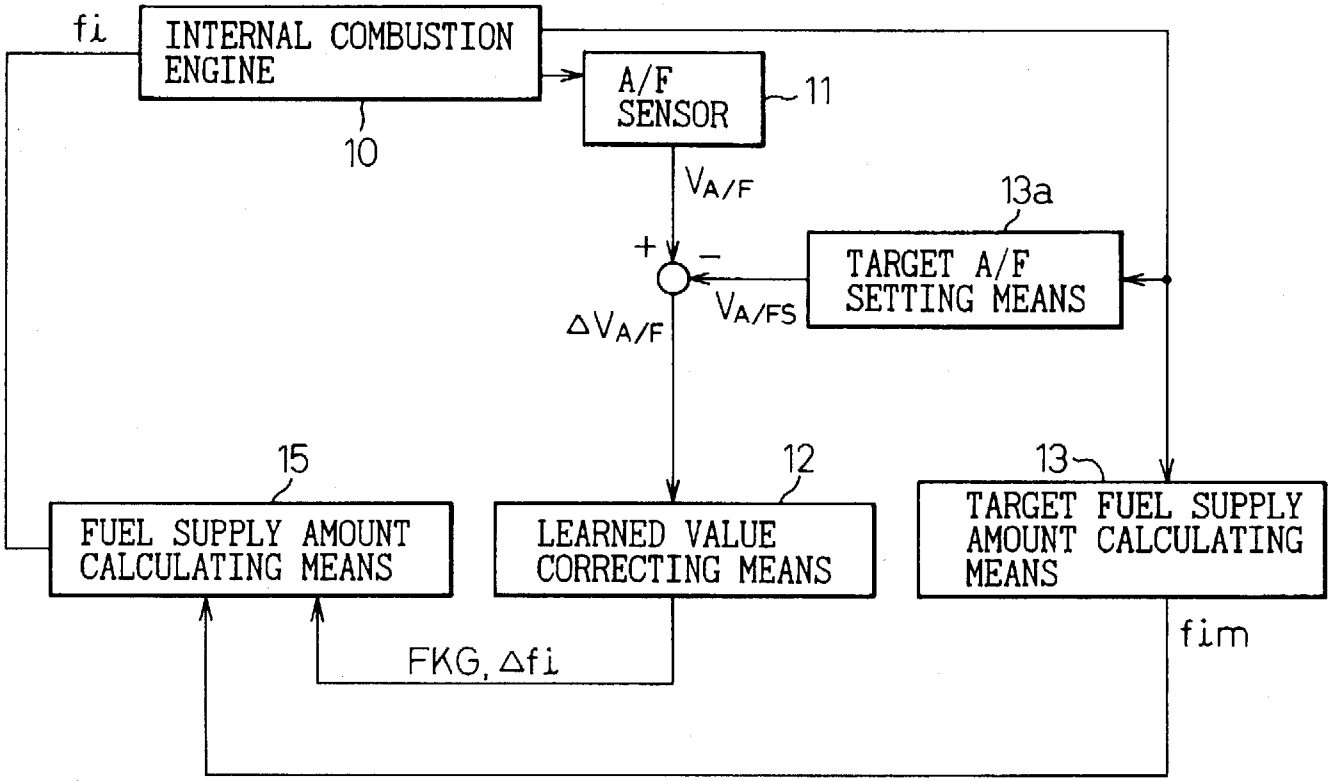
FIGS. 1 to 5 are block diagrams each showing a different basic constitution of an apparatus for controlling the air-fuel ratio in an internal combustion engine according to the present invention.
Figure 2:
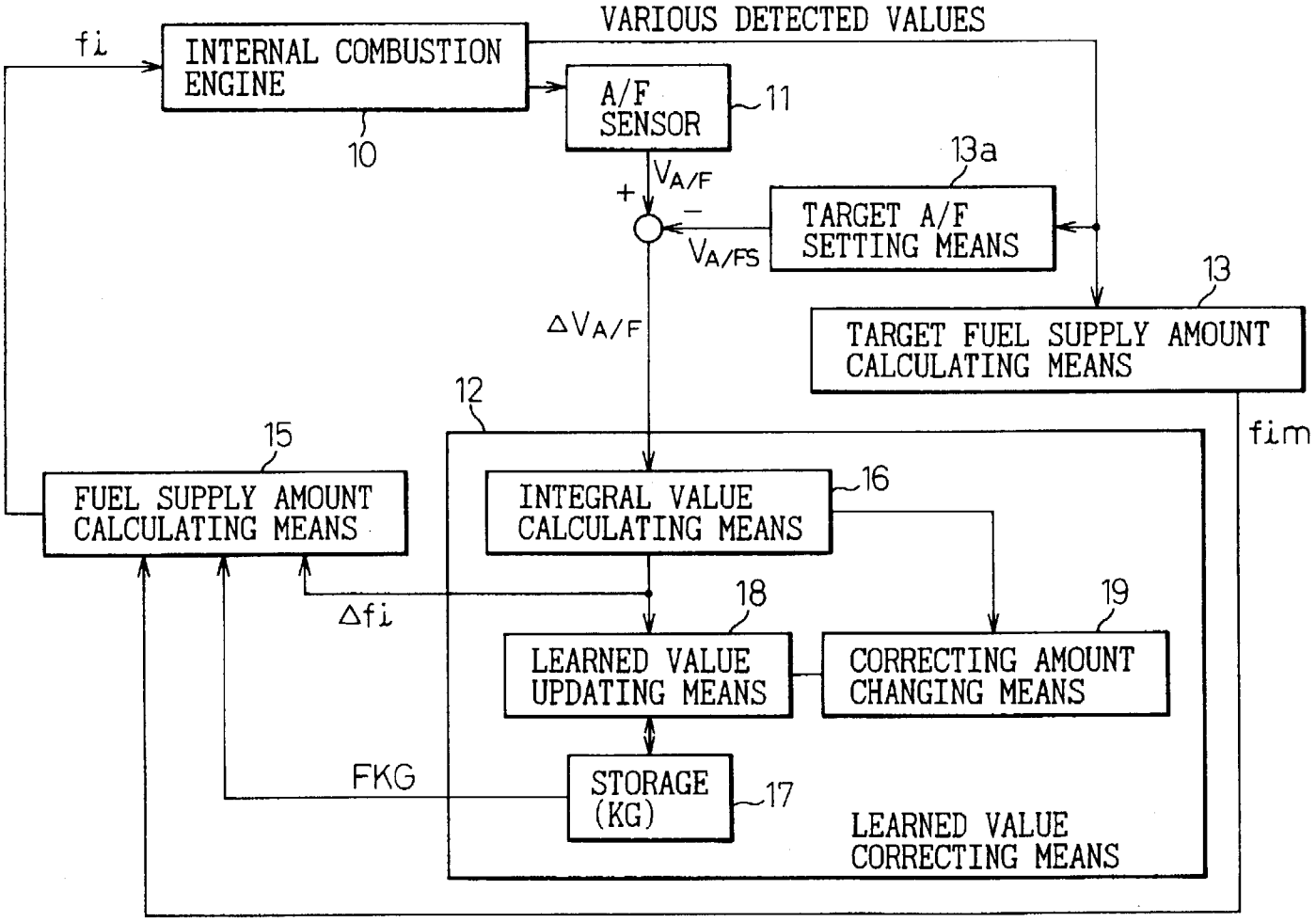
Figure 7:
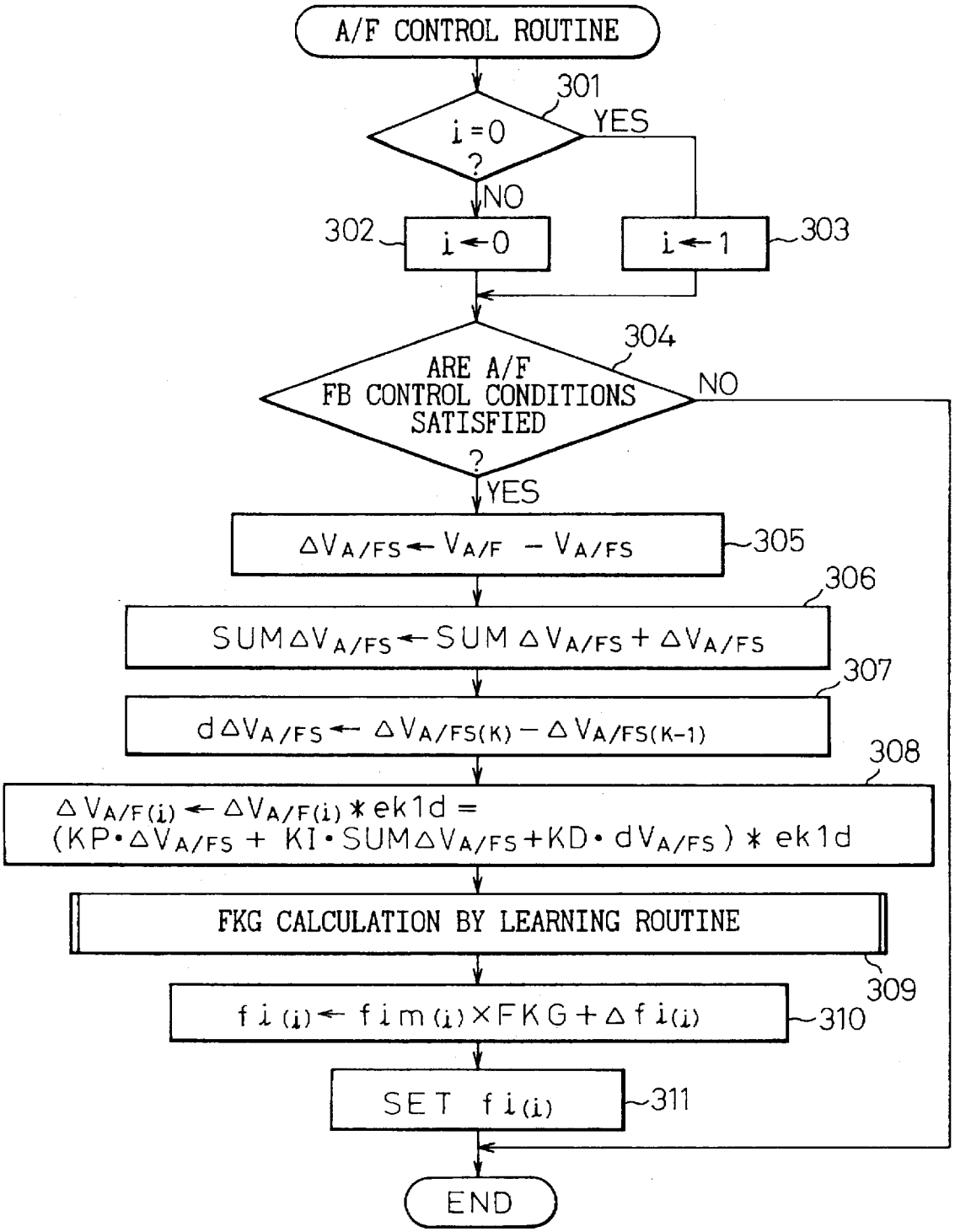
FIG. 7 shows a flow chart of a method for controlling the air-fuel ratio according to a first embodiment of the present invention.

FIG. 7 shows a flow chart of a method for controlling the air-fuel ratio according to a first embodiment of the present invention explained with reference to FIG. 2. The routine shown in FIG. 7 is executed by the control circuit 30 based on the PID control every predetermined number of degrees in the crank angle of the engine, for example, every 360 degrees in crank angle (360° CA).

A flag "i" is alternatively changed from 0 to 1 or from 1 to 0 every processing cycle in steps 301 to 303. The value of the flag "i" represents the cylinder bank A or B to which the fuel is to be supplied and the fuel injection amount is to be calculated. When i=0, the fuel injection amount for the cylinder bank A is calculated. When i=0, the fuel injection amount for the cylinder bank B is calculated. After the value i is determined by executing steps 301 to 303, a storage area for the bank A or B is allocated in the RAM 105 depending on the value i. In case i=0, a storage area for the bank A is allocated in the RAM 105 and the fuel injection amount for the cylinder bank A calculated from the output of the air-fuel ratio sensor 33A for the cylinder bank A and the like are stored in the storage for the bank A. (In this case, the suffix (i) shown in steps 308, 310 and 311 represents the letter A. In case i=1, a storage area for the bank B is allocated in the RAM 105 and the fuel injection amount for the cylinder bank B calculated from the output of the air-fuel ratio sensor 33B for the cylinder bank B and the like are stored in the storage for the bank B. (In this case, the suffix (i) shown in steps 308, 310 and 311 represents the letter B. By executing the steps 301 to 303, both the fuel injection amounts for the cylinder banks A and B can be once calculated in every processing cycle, namely, every 720 degrees of crank angle (720° CA).

In step 304, conditions to execute the air-fuel ratio feedback control in response to the output of the air-fuel ratio sensors 33A and 33B are checked. If all the conditions below are satisfied, the process proceeds to step 305, if at least one of the conditions below is not satisfied, the process ends. The following are the conditions, (1) The coolant temperature equal to or more than the predetermined degrees.

(2) The engine start-up is finished.

(3) The air-fuel ratio enrichment, such as a start-up air-fuel ratio enrichment, a warming-up air-fuel ratio enrichment, a power air-fuel ratio enrichment, or an OTP air-fuel ratio enrichment for preventing an excess rise in the temperature of the catalytic converters, is not being carried out, or a predetermined time has passed since after the above enrichment has been carried out.

(4) The fuel cut operation is not being carried out or a predetermined time has passed since after the fuel cut has been carried out.

(5) The air-fuel ratio sensors 33A and 33B have been activated after the engine start-up finished.

In step 305, the deviation AVAIFS is calculated from the output $V_{A/F}$ of the air-fuel ratio sensor and the reference value $V_{A/FS}$ corresponding to the stoichiometric air-fuel ratio by the following equation.

$$\Delta V_{A/FS}=V_{A/F}-V_{A/FS}$$

The air-fuel ratio sensor output $V_{A/F(i)}$ corresponding to the A bank or the B bank is converted from analog data to digital data, read and stored the updated data into the RAM 105 every predetermined period of time, for example, every 8 ms (milliseconds).

In step 306, the integral value SUM $\Delta V_{A/FS}$ is calculated with the deviation $\Delta V_{A/FS}$ by the following equation, $$SUM\ \Delta V_{A/FS}=SUM\ \Delta V_{A/FS}+\Delta V_{A/FS}$$

In step 307, the differential value $d\Delta V_{A/FS}$ that is the amount of change in deviation $\Delta V_{A/FS}$ from the previous processing cycle to the current processing cycle is calculated by the following equation, $$d\Delta V_{A/FS}=\Delta V_{A/FS(k)}-\Delta V_{A/FS(k-1)}$$

wherein $\Delta V_{A/FS(k)}$ represents the deviation obtained in the current processing cycle and $\Delta V_{A/FS(k-1)}$ represents the deviation obtained in the previous processing cycle.

In step 308, the air-fuel ratio feedback correcting amount $\Delta V_{A/F(i)}$ is calculated by the following equation, $$\Delta V_{A/F(i)}=KP*\Delta V_{A/FS}+KI*(SUM\ \Delta V_{A/FS})+KD*d\Delta V_{A/FS}$$

$$\Delta f_{i(i)}=\Delta V_{A/F(i)}*ekld$$

wherein ekld represents an engine load correction factor previously determined in accordance with engine load conditions.

In step 309, the learning routine is carried out to calculate the air-fuel ratio leaning correction factor FKG. This routine will be explained later.

In step 310, the fuel injection amount $fi_{(i)}$ is calculated by the following equation, $$fi_{(i)}=fim_{(i)}*FKG+\Delta fi_{(i)}$$

wherein, $fim_{(i)}$ represents a basic fuel injection amount and $\Delta fi_{(i)}$ represents the fuel injection amount correction factor.

In step 311, the fuel injection amount (time) $fi_{(i)}$ is set in the down counter **108(*i*) in the control circuit 30, thereby the drive circuit 110(*i*) is driven to inject the calculated fuel amount fi(i) in step 310 from the fuel injection valve 27(*i*)**.

Figure 8:
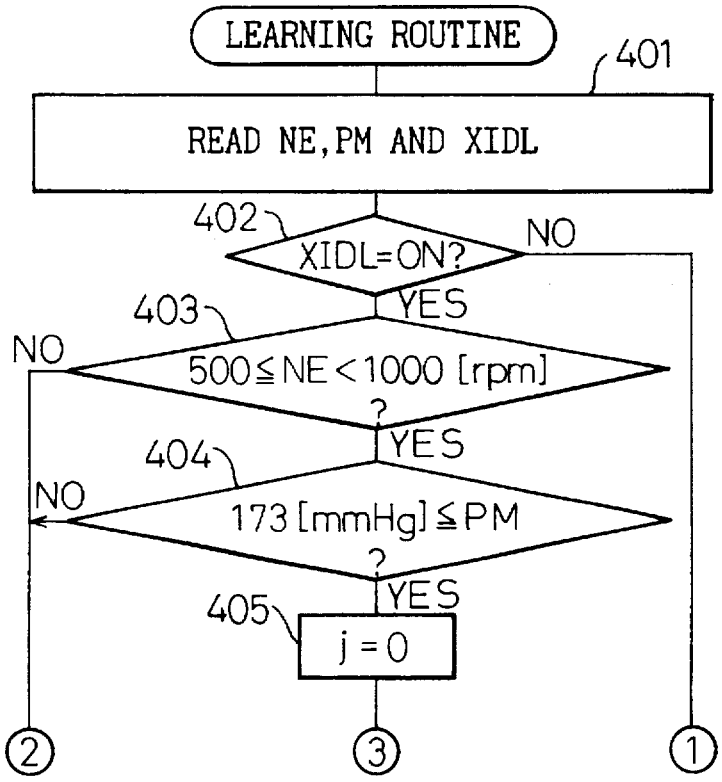
FIGS. 8 to 10 show a flow chart of a routine for learning the integral factor of an air-fuel ratio correction factor according to a first embodiment of the present invention.
Figure 9:
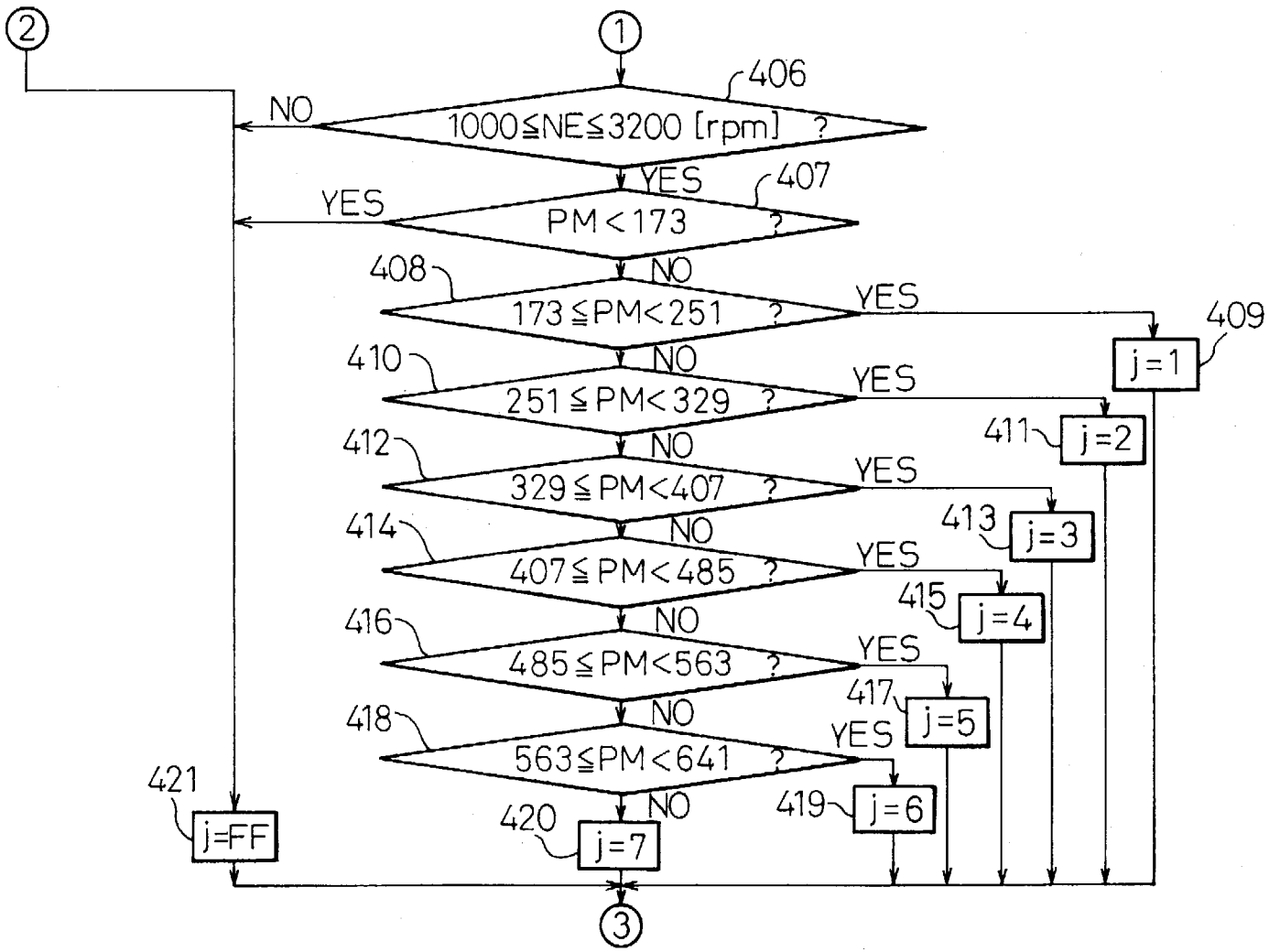
Figure 10:
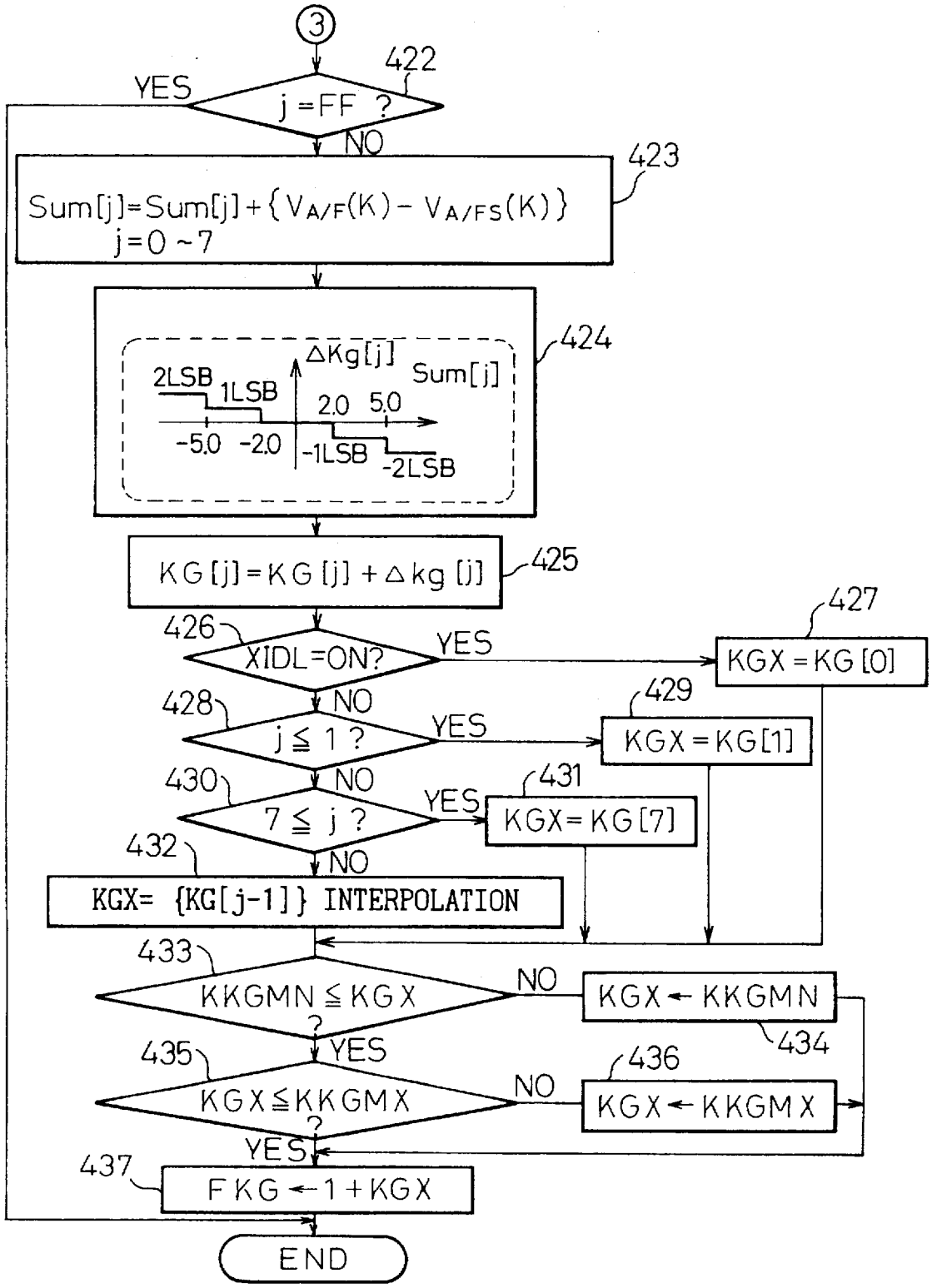

FIGS. 8 to 10 show a flowchart of a routine for learning the integral factor of an air-fuel ratio correction factor according to a first embodiment of the present invention. This learning routine is executed by the control circuit 30 every predetermined number of degrees in the crank angle of the engine, for example, every 360 degrees of crank angle (360° CA) or every predetermined period of time.

The first part of this routine shown in FIGS. 8 and 9 is provided to determine a domain corresponding to the current engine operating condition from among eight sections (j=0 to 7) divided based on the engine operating conditions such as the engine speed (RPM) and the load (PM). The last part of the routine shown in FIG. 10 is provided to calculate the learned value FKG of the air-fuel ratio correcting factor.

In step 401, the rotational speed NE, intake air pressure PM and the state XIDL of the idling switch 39 of the engine 21 are read. In step 402, whether XIDL is 0 or 1 is checked, if XIDL is 1, It is considered that the engine is in an idling state and the process proceeds to step 403, if XIDL is 0, it is considered that the engine is not in an idling state and the process proceeds to step 406. In step 403, whether or not the rotational speed of the engine 21 is 500≦NE<1000 (RPM) is checked and, if the result is YES, the process proceeds to step 404 and, if the result is NO, the process proceeds to 421. In step 404, whether or not the intake air pressure PM of the engine 21 is equal to or greater than 173 (mmHg) (≧173 (mmHg)) is checked, if the result is YES, the process proceeds to step 405, if the result is NO, the process proceeds to 421. In step 405, j is set to 0, that indicates the current engine operating condition is in No. 0 domain (j=0).

In step 406, whether or not the rotational speed of the engine 21 is 1000≦NE≦3200 (RPM) is checked, if the result is YES, the process proceeds to step 407, if the result is NO, the process proceeds to 421. In step 407, whether or not the intake air pressure PM of the engine 21 is less than 173 (mmHg) (<173 (mmHg)) is checked, if the result is YES, the process proceeds to step 421, if the result is NO, the process proceeds to 408. In step 408, whether or not the intake air pressure PM is equal to or greater than 173 (mmHg) and less than 251 (mmHg) (173≦PM<251 (mmHg)) is checked, if the result is YES, the process proceeds to step 409, if the result is NO, the process proceeds to 410. In step 409, j is set to 1, and this indicates that the current engine operating condition is in the No. 1 domain (j=1), then the process proceeds to step 422. From step 410 to 422, j is set to 2 to 7 depending on the intake air pressure PM, for example, j is set to 2 when 251<PM<329, j is set to 3 when 329≦PM<407, j is set to 4 when 407≦PM<485, j is set to 5 when 485≦PM<563, j is set to 6 when 563≦PM<641 and j is set to 7 when 641≦PM.

If it is determined NO in steps 403, 404, 406 and 407, it is regarded that the air-fuel ratio feedback control conditions are not satisfied and the process proceeds to step 421. In step 421, j is set to hexadecimal FF.

FIG. 10 shows a flow chart of a routine for learning the integral factor FKG of an air-fuel ratio correction factor corresponding to each domain in the engine operating condition determined by executing steps 401 to 421. In step 422, whether or not j=FF is checked, if j=FF, the process ends, if j≠FF, the process proceeds to step 423.

In step 423, the integral value is calculated by the following equation, $$SUM\ (j)=SUM\ (j)+(V_{A/F}(k)-V_{A/FS}(k))$$

wherein j=0 to 7 (integer), $V_{A/F}(k)$ represents the output of the air-fuel ratio sensor **33(*i*) at the current processing cycle, VA/FS(k) represents the output from the air-fuel ratio sensor 33(*i*) when the mixture supplied to the engine 21** is stoichiometric and the initial value of the integral value SUM (j) is 0.

Next, in step 424, the learned correcting amount Δkg(j) is read from a map previously stored in the RAM 105 in which the amount Δkg(j) for each domain from j=0 to 7 corresponds to the integral value SUM (j) for each domain from j=0 to 7, the domain is determined depending on the current engine operating condition.

In step 424, the value of LSB shown in FIG. 10 may be substituted by, for example, 1/512. As can be seen from the map in FIG. 10, as the integral value SUM (j) increases, the learned correcting amount Akg(j) decreases. Next, in step 425, the learned value KG (J) is calculated by the following equation and updated.

$$KG(J)=KG(J)+\Delta kg(j)$$

In step 426, the engine idle state signal XIDL is determined, and if XIDL=1, the process proceeds to 427, if XIDL=0, the process proceeds to step 428. In step 427, KGX is set by KG (0), then the process proceeds to step 433. In step 428, j≦1 is checked, if j≦1, the process proceeds to step 429, KGX is by set KG (1) and the process proceeds to step 433. If j>1 in step 428, the process proceeds to step 430. In step 430, 7≦j is checked, if 7≦j, the process proceeds to step 431, KGX is set by KG (7) and the process proceeds to step 433. If 1<j<7, in step 430, the process proceeds to step 432. In step 432, KGX is determined by the interpolation between KG (j) and KG (j−i), and the process proceeds to step 433.

In step 433, KGX is compared with the lower limit guard value KKGMN, If KKGMN≦KGX, the process proceeds to step 435, if KKGMN>KGX, the process proceeds to step 434, KGX is set by KKGMN and the process proceeds to step 437. In step 435, KGX is compared with the upper limit guard value KKGMX, if KGX≦KKGMX, the process proceeds to step 437, if KGX>KKGMX, the process proceeds to step 436, KGX is set by KKGMX and the process proceeds to step 437. In step 437, the learned correction factor FKG is calculated by the following equation, stored in the RAM 105 and the process ends.

$$FKG=1+KGX$$

In step 424, LSB is set by 1/512 as an example, however, LSB can be set to any other data, whereby the speed of learning the learned correcting amount Δkg(j) can be adjusted. The speed is proportional to the value of LSB.

Heretofore, the method and apparatus of the air-fuel ratio feedback control based on the PID control according to the present invention has been explained. Hereafter, the method and apparatus of the air-fuel ratio feedback control based on the modern control according to the present invention will be explained. The applicant of the present invention proposed the technique of the air-fuel ratio feedback control based on the modern control technology, which causes the air-fuel ratio in the engine to be precisely converged into the stoichiometric air-fuel ratio in a short time in consideration of maintaining the amount of oxygen adsorbed by the catalyst in a determined amount for the purpose of utilizing the most of the oxygen storage function of the three-way catalyst. The applicant has filed an invention related to this technique (Japanese Patent Application No. 5-68391 should be referred to).

Figure 5:
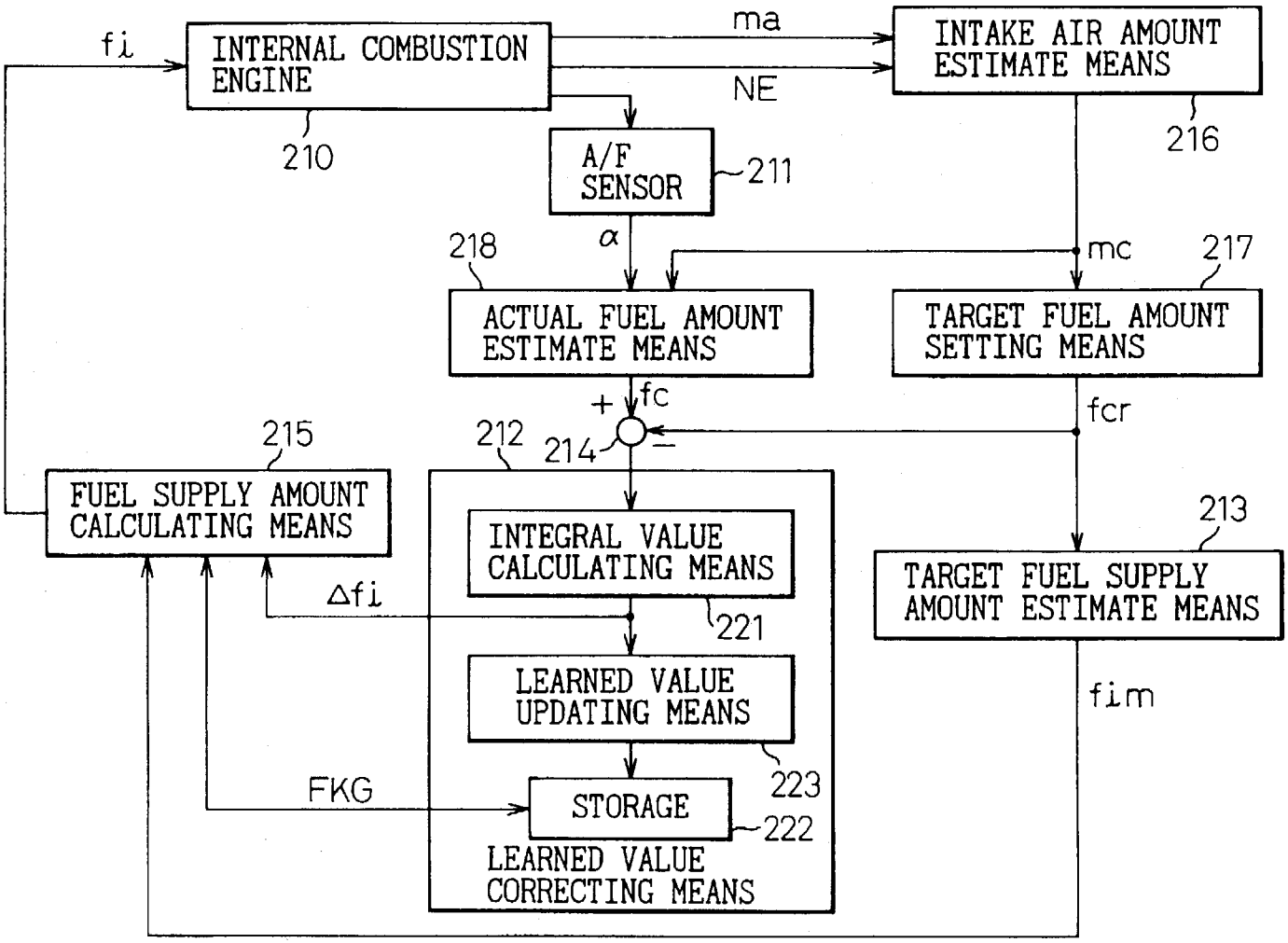
Figure 11:
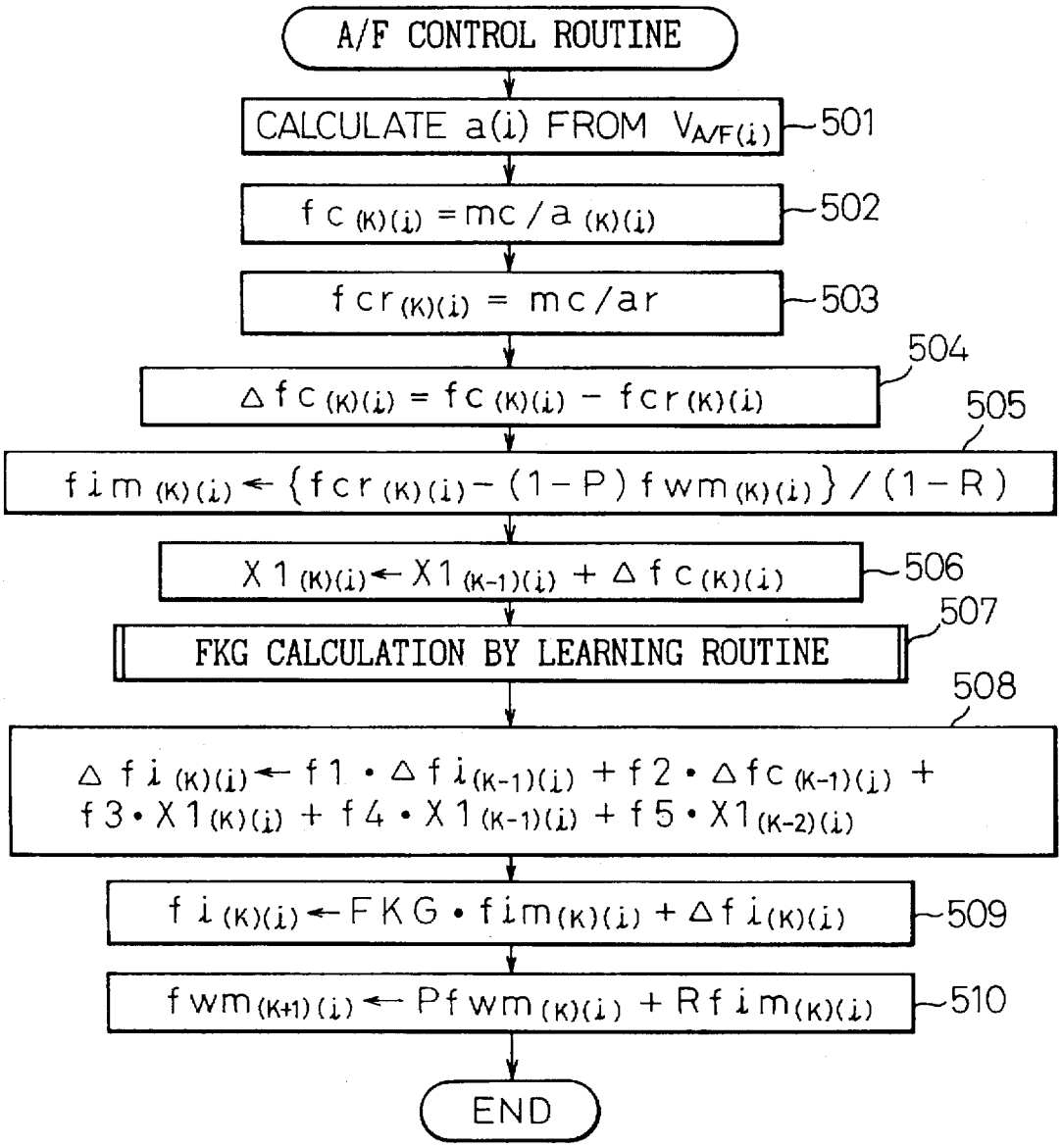
FIG. 11 shows a flow chart of a method for controlling the air-fuel ratio according to a second embodiment of the present invention.

FIG. 11 shows a flow chart of a method for controlling the air-fuel ratio according to a second embodiment of the present invention explained with reference to FIG. 5. The routine shown in FIG. 11 is executed by the control circuit 30 based on the modern control technology every predetermined number of degrees in the crank angle of the engine, for example, every 360 degrees in crank angle (360° CA).

In step 501, the air-fuel ratio a (i) is calculated from the linear output characteristic (not shown) of the air-fuel ratio sensor 33(*i*) in response to the output $V_{A/F(i)}$ of the sensor 33(*i*). In steps 502 and 503, the fuel amount $fc_{(k)(i)}$ actually supplied to the cylinder and the target air-fuel fuel amount $fcr_{(k)(i)}$ are respectively calculated from the air-fuel ratio α (i) calculated in step 501, an intake air amount per engine revolution mc calculated from the output of the air flow meter 23 and the engine rotational speed and the stoichiometric air-fuel ratio αr (constant value). In step 504, the deviation $\Delta fc_{(k)(i)}$ between $fc_{(k)(i)}$ and $fcr_{(k)(i)}$ is calculated by the following equation, $$\Delta fc_{(k)(i)}=fc_{(k)(i)}-fcr_{(k)(i)}$$

In step 505, a nominal value fim(i) is calculated by the following equation, $$fim_{(k)(i)}=(fcr_{(k)(i)}-(1-P)fwm_{(k)(i)})/(1-R)$$

In the second embodiment, the fuel injection amount $fi_{(i)}$, a fuel amount $fw_{(i)}$ deposited on the wall of the intake port or the like from the injected fuel and the fuel amount $fc_{(i)}$ supplied into the cylinder are expressed as below, $$fi_{(i)}=fim_{(i)}+\Delta fi_{(i)}$$

$$fw_{(i)}=fwm_{(i)}+\Delta fw_{(i)}$$

$$fc_{(i)}=fcm_{(i)}+\Delta fc_{(i)}$$

wherein fim(i), $fwm_{(i)}$ and $fcm_{(i)}$ are nominal values, and $\Delta fi_{(i)}$, $\Delta fw_{(i)}$ and $\Delta fc_{(i)}$ are corresponding deviations.

It is assumed that the following model expressions are satisfied between the above nominal values and the deviations.

$$fw_{(k+1)(i)}=Pfw_{(k)(i)}+Rfi_{(k)(i)}$$

$$fc_{(k)(i)}=(1-P)fw_{(k)(i)}+(1-R)fi_{(k)(i)}$$

$$fwm_{(k+1)(i)}=Pfwm_{(k)(i)}+Rfim_{(k)(i)}$$

$$fcm_{(k)(i)}=(1-P)fwm_{(k)(i)}+(1-R)fim_{(k)(i)}$$

$$fcm_{(k)(i)}=fcr_{(k)(i)}$$

wherein the suffix (k) indicates that values are at the current processing cycle, the suffix (k−1) indicates that values are at the previous processing cycle and P and R are constant values. In step 505, the nominal value $fim_{(i)}$ can be calculated as a variation of the above model expressions as below.

$$fim_{(k)(i)}=(fcr_{(k)(i)}-(1-P)fwm_{(k)(i)})/(1-R)$$

Next, in step 506, the integral value $x1_{(i)}$ of $\Delta fc_{(i)}$ is calculated by the following equation.

$$x1_{(k)(i)}=x1_{(k-1)(i)}+\Delta fc_{(k)(i)}$$

In step 507, in the same way as explained the first embodiment with reference to FIGS. 8 to 10, the integral value is learned and the calculated learned correction factor FKG is stored in the RAM 105. However, the equation shown in step 423 in FIG. 10 is replaced as below.

$$Sum\ (j)=Sum\ (j)+(fc(k)-fcr(k)) \qquad (j=0 \text{ to } 7)$$

Namely, the deviation between the actual fuel amount to be supplied to the cylinder and the target amount is integrated. Since the fuel amount fc is calculated as the ratio mc/α of the intake air amount mc to the air-fuel ratio α, the deviation as the fuel amount is shown large even though the air-fuel ratio is small. This happens more apparaently in domains where the intake air amount is large. Therefore, the larger the intake air amount in the range where the absolute fuel amount becomes large, the deviation and the learned value can be more accurately calculated.

In step 508, the deviation $\Delta fi_{(i)}$ is calculated by the following equation, $$\begin{aligned}\Delta fi_{(k)(i)} = {} & f1*\Delta fi_{(k-1)(i)} + f2*\Delta fc_{(k-1)(i)} \\ & + f3*x1_{(k)(i)} + f4*x1_{(k-1)(i)} \\ & + f5*x1_{(k-2)(i)}\end{aligned}$$

wherein f1 to f5 are constant.

In step 509, the fuel injection amount $fi_{(i)}$ is calculated by the following equation, $$fi_{(k)(i)}=FKG*fim_{(k)(i)}+\Delta fi_{(k)(i)}$$

In step 510, the nominal value fwm(i) of fuel amount deposited on the wall of the intake port at the next processing cycle is calculated from the current nominal values $fwm_{(i)}$ and $fim_{(i)}$ by the following equation.

$$fwm_{(k+1)(i)}=Pfwm_{(k)(i)}+Rfim_{(k)(i)}$$

The above explained fuel injection amount $fi_{(i)}$ is set to the corresponding down counter $108_{(i)}$ in the control circuit 30 as explained in step 310 referring to FIG. 7, then the fuel injection is carried out. Thus, the very precise air-fuel ratio control can be realized.

Figure 12:
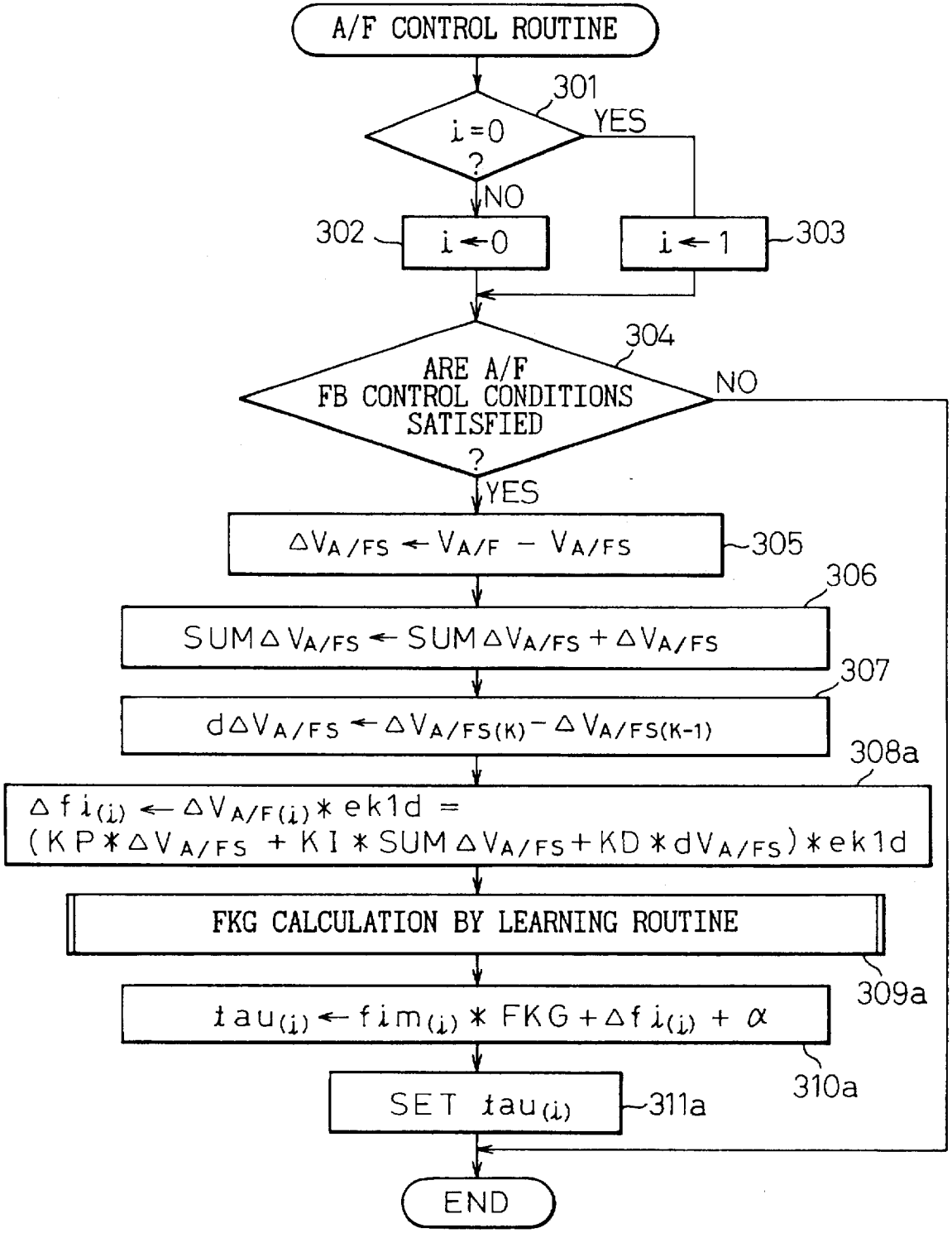
FIG. 12 shows a flow chart of a method for controlling the air-fuel ratio according to a third embodiment of the present invention.

FIG. 12 shows a flow chart of a method for controlling the air-fuel ratio according to a third embodiment of the present invention. The flow chart shown in FIG. 12 is different from FIG. 7 in steps 308 to 311. Steps 308 to 311 in FIG. 7 are replaced by steps 308*a* to 311*a* in FIG. 12. Steps 308*a* to 311*a* will be explained below.

In step 308*a*, the air-fuel ratio feedback correcting amount $\Delta fi_{(i)}$ is calculated by the following equation, $$\Delta V_{A/F(i)}=KP*\Delta V_{A/FS}+KI*(SUM\ \Delta V_{A/FS})+KD*d\Delta V_{A/FS}$$

$$\Delta fi_{(i)}=\Delta V_{A/F(i)}*ekld$$

wherein ekld represents an engine load correction factor previously determined in accordance with engine load conditions.

In step 309*a*, the learning routine is carried out to calculate the air-fuel ratio leaning correction factor FKG. This routine will be explained later.

In step 310*a*, the fuel injection amount $tau_{(i)}$ is calculated by the following equation, $$tau_{(i)}=fim_{(i)}*FKG+\Delta fi_{(i)}+\alpha$$

wherein, $fim_{(i)}$ represents a basic fuel injection amount, $\Delta fi_{(i)}$ represents the fuel injection amount correction factor and α represents the other correction factor, for example, the transient time correction factor fmw.

In step 311*a*, the fuel injection time $tau_{(i)}$ is set in the down counter 108(*i*) in the control circuit 30, thereby the drive circuit 110(*i*) is driven for the calculated fuel injection time $tau_{(i)}$ in step 310*a* to inject the fuel from the fuel injection valve 27(*i*).

Figure 3:
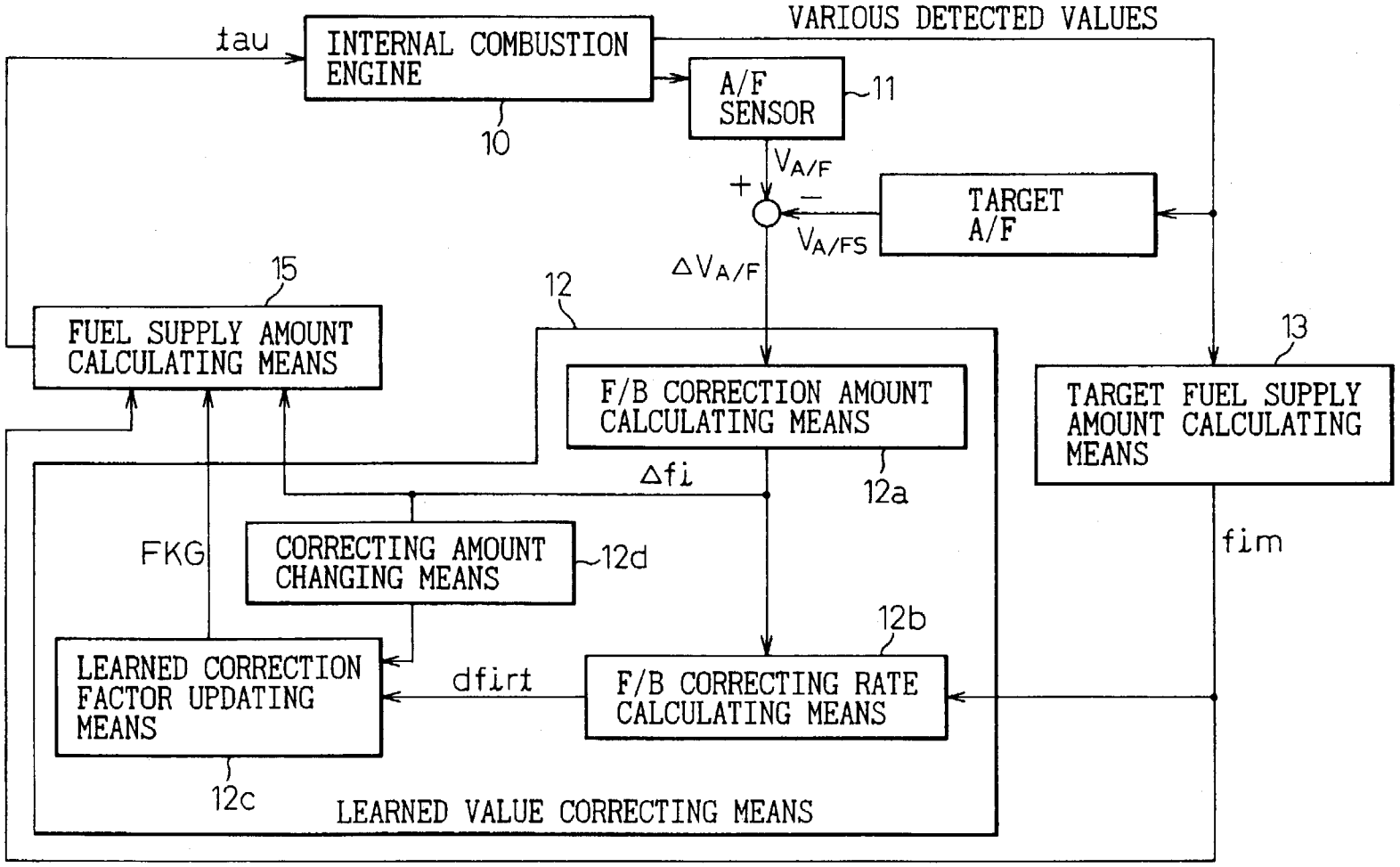
Figure 4:
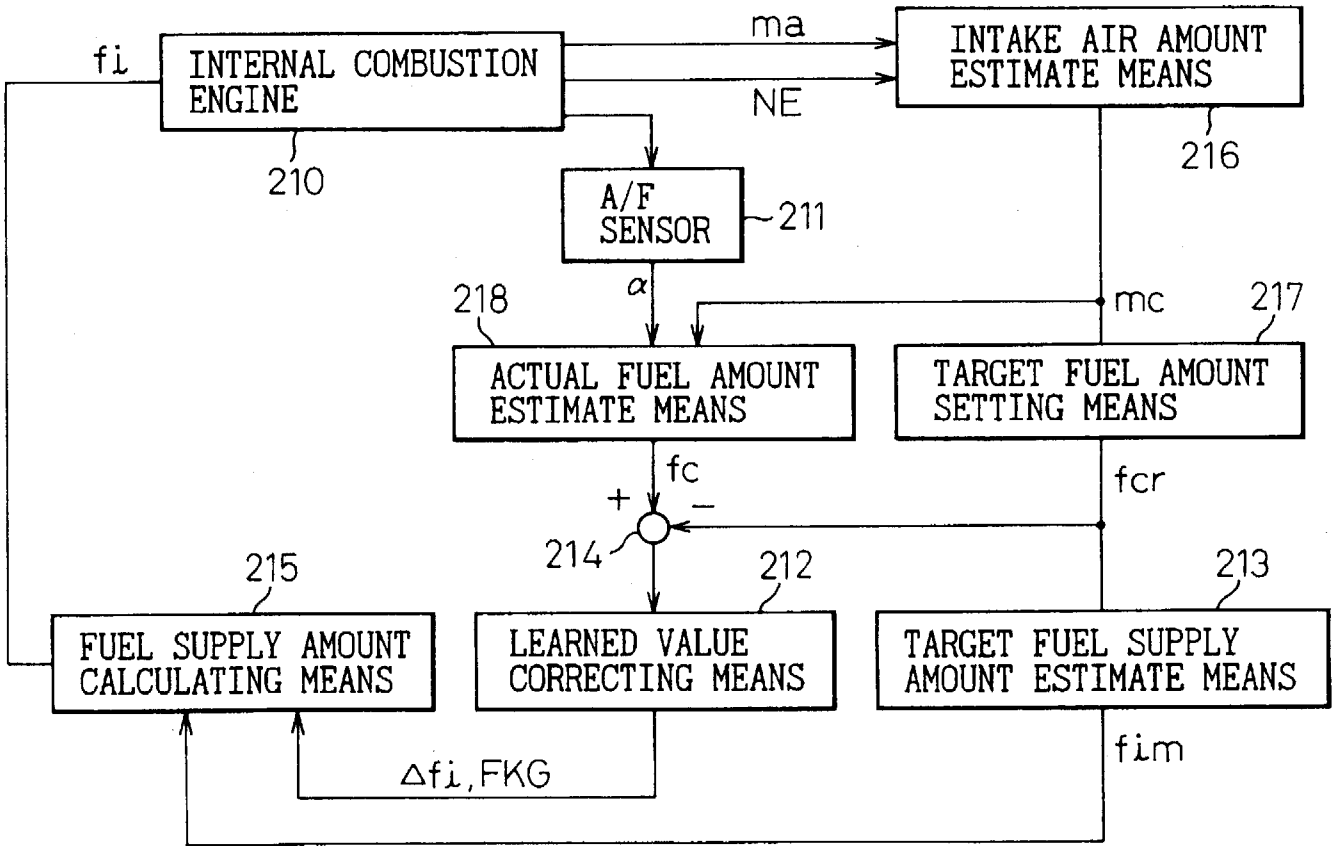
Figure 13:
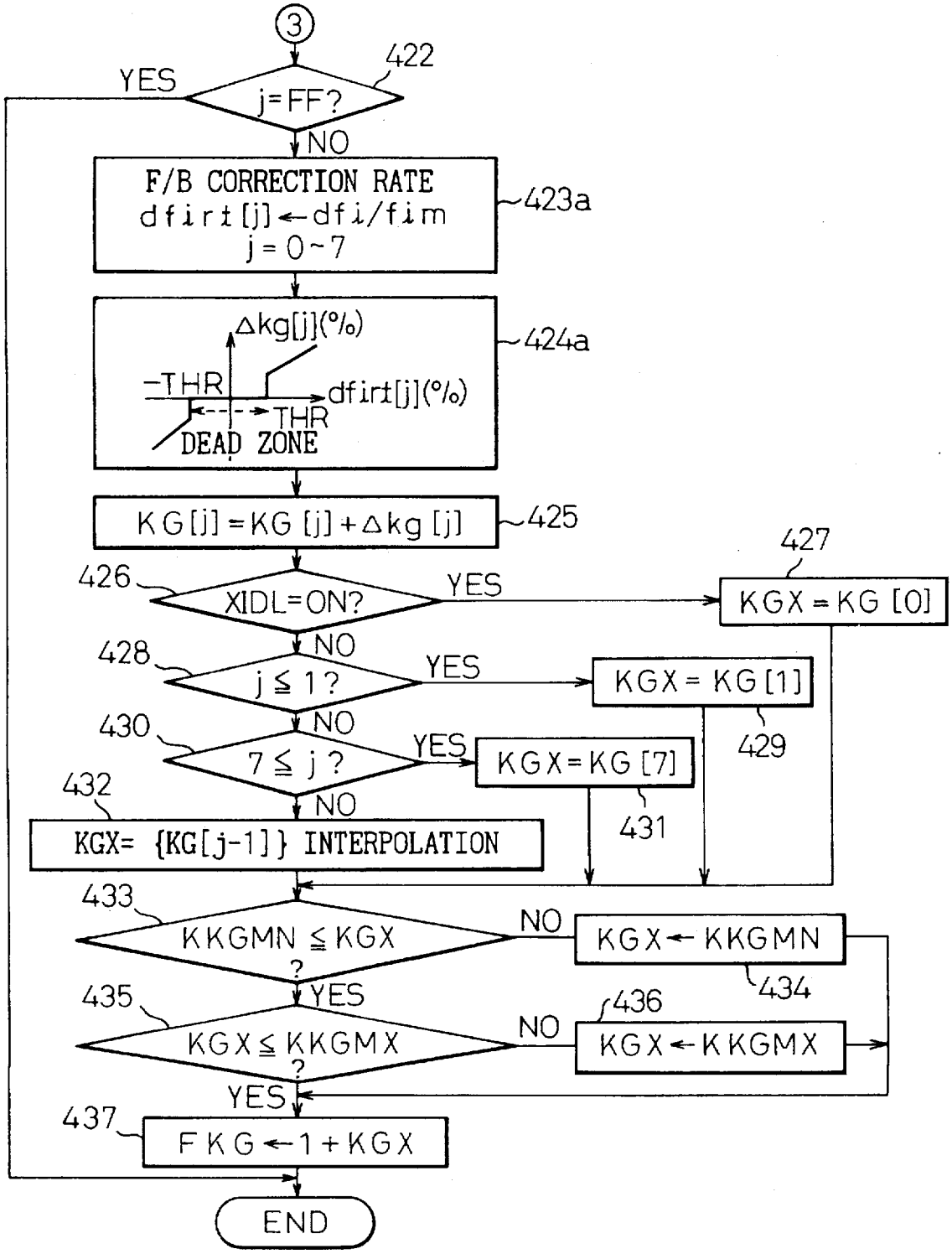
FIG. 13 shows the last part of a flow chart of a routine for learning the integral factor of an air-fuel ratio correction factor according to the third embodiment of the present invention.

FIG. 13 shows the last part of a flow chart of a routine for learning the integral factor of an air-fuel ratio correction factor according to the third embodiment of the present invention with reference to FIG. 3. The flow chart shown in FIG. 13 is different from FIG. 10 in steps 423 and 424. Steps 423 and 424 in FIG. 10 are replaced by steps 423*a* and 424*a* in FIG. 13. Steps 423*a* and 424*a* will be explained below.

In step 423*a*, the feedback correction rate dfirt (j) (%) is calculated by the following equation, $$dfirt\ (j)=\Delta fi_{(i)}/fim(i)$$

wherein j=0 to 7 (integer) corresponding to a domain in an engine operating condition, $\Delta fi_{(i)}$ represents the air-fuel ratio feedback correction amount and $fim_{(i)}$ represents the basic fuel injection amount. Therefore, it is understood that the feedback correction rate dfirt (j) (%) represents the ratio of the feedback correction amount to the basic fuel injection amount in the current processing cycle.

Next, in step 424*a*, the learned correcting amount Δkg(j) is read from a map previously stored in the RAM 105 in which the amount Δkg(j) for each domain from j=0 to 7 corresponds to the feedback correction rate dfirt (j) (%) for each domain from j=0 to 7, and the domain is determined depending on the current engine operating condition.

As can be understood from the map shown in step 424*a* in FIG. 13, when the feedback correction rate dfirt (j) exceeds the dead zone, the learned correcting amount Δkg(j) is given, and after the rate exceeds the threshold value THR, the learned correcting amount Δkg(j) proportionally increases. The correcting amount Δkg(j) may be discretely increased as the rate dfirt (j) increases. Furthermore, the correcting amounts Δkg(j) are set as adjustable data and the leaning speed of the air-fuel ratio leaning correction factor FKG can be changed, thereby controlling the air-fuel ratio from the engine to quickly reach to the target air-fuel ratio.

As heretofore explained, according to the present invention, the linear type air-fuel ratio sensor is used to detect the actual air-fuel ratio or to estimate the actual fuel supply amount, a deviation between the actual air-fuel ratio and a target air-fuel ratio or a deviation between the actual fuel supply amount and the target fuel supply amount is calculated, the deviation corresponding to a domain of the engine operating condition is calculated and integrated, and a learned value is updated in response to the integrated value, therefore, the deviation is independent of each domain, not influenced from the previous or subsequent deviation, namely, the integrated value is independent of each domain, not influenced from the adjacent domain, and the learned value is also independent of each domain, not influenced from the adjacent domain, thus the accurate learned value corresponding to each domain of the engine operating condition can be obtained, a very precise air-fuel ratio feedback control can be realized, and the exhaust gas from the engine can be better purified.

According to the correcting amount changing means of the present invention, the learned value can be changed in response to the integrated value, so that the learning speed of the learned value can be quickened resulting in quick response to the deviation in the air-fuel ratio and the exhaust gas discharged from the engine can be better purified.

According to the present invention, the feedback correction rate calculated as a ratio of the feedback correction amount to the target fuel supply amount is used as a parameter, thus the learned correction factor is updated corresponding to the feedback correction amount, and accurate air-fuel ratio learning control is enabled.

Furthermore, according to the present invention, the learned correction factor is updated when the feedback correction rate exceeds a threshold level, regardless of the change in the value of a P (proportional) gain or an I (integral) gain for determining the feedback correction amount, or the change in the value of the engine load correction factor for correcting the feedback correcting amount in response to the change in the engine load, thus the delay in purifying the exhaust gas discharged from the engine and the occurrence of hunting in the air-fuel ratio feedback control can be avoided.

It will be understood by those skilled in the art that the foregoing descriptions are preferred embodiments of the disclosed apparatus and that various changes and modifications may be made in the invention without departing from the split and scope thereof.

We claim:

1. An apparatus for controlling the air-fuel ratio in an internal combustion engine comprising:

a linear type air-fuel ratio sensor provided in the exhaust system of the engine;

a means for calculating a target fuel supply amount in response to the engine operating condition, the target fuel supply amount being predetermined so that the air-fuel ratio of the mixture supplied to the engine becomes a target air-fuel ratio;

a means for correcting learned values, each corresponding to each domain divided into a plurality of sections of the engine operating condition, based on a deviation between an actual air-fuel ratio calculated from the output of the air-fuel ratio sensor and the target air-fuel ratio; and a means for calculating a fuel supply amount to the engine based on the target fuel supply amount and the learned value respectively calculated by the above means and a feedback correction amount calculated in response to the deviation.

2. An apparatus according to claim 1, wherein the means for correcting learned values comprises:

a means for calculating integral values each obtained by integrating a deviation between an actual air-fuel ratio calculated from the output of the air-fuel ratio sensor and the target air-fuel ratio, each integral value being corresponding to each domain divided into a plurality of sections of the engine operating condition;

a storage for storing learned values corresponding to the integral values of the deviations each obtained corresponding to each domain of the engine operating condition; and a means for updating the learned values stored in the storage corresponding to the integral values calculated by the integral value calculating means.

3. An apparatus according to claim 2 further comprising a means for changing a correcting amount of the learned value in response to the integrated value.

4. An apparatus according to claim 1, wherein the means for correcting learned values comprises:

a means for calculating a feedback correcting amount based on a deviation between the actual air-fuel ratio calculated from the output of the air-fuel ratio sensor and the target air-fuel ratio;

a means for calculating a feedback correcting rate of the target fuel amount to the feedback correcting amount; and a means for updating a learned correction factor based on the comparison of the feedback correcting rate and a threshold level of the rate.

5. An apparatus according to claim 4 further comprising a means for changing a correcting amount of the learned value in response to the integrated value.

6. An apparatus for controlling the air-fuel ratio in an internal combustion engine comprising:

a linear type air-fuel ratio sensor provided in the exhaust system of the engine;

a means for calculating a target fuel supply amount in response to the engine operating condition, the target fuel supply amount being predetermined so that the air-fuel ratio of the mixture supplied to the engine becomes a target air-fuel ratio;

a means for correcting learned values, each corresponding to each domain divided into a plurality of sections of the engine operating condition, based on a deviation between an actual fuel supply amount calculated from the output of the air-fuel ratio sensor and the target fuel supply amount; and a means for calculating a fuel supply amount to the engine based on the target fuel supply amount and the learned value respectively calculated by the above means and a feedback correction amount calculated in response to the deviation.

7. An apparatus according to claim 6, wherein the means for correcting the learned values comprises:

a means for calculating integral values each obtained by integrating a deviation between an actual fuel supply amount calculated from the output of the air-fuel ratio sensor and the target fuel supply amount, each integral value being corresponding to each domain divided into a plurality of sections of the engine operating condition;

a storage for storing learned values corresponding to the integral values of the deviations each obtained corresponding to each domain of the engine operating condition; and a means for updating the learned values stored in the storage corresponding to the integral values calculated by the integral value calculating means.

* * * * *

UNITED STATES PATENT AND TRADEMARK OFFICE

CERTIFICATE OF CORRECTION

PATENT NO. : 5,752,492

DATED : May 19, 1998

INVENTOR(S) : Yoshihiko KATO, et al.

It is certified that error appears in the above-identified patent and that said Letters Patent is hereby corrected as shown below:

Column 2, line 64, change "VAIF" to --$V_{A/F}$--.

Column 4, line 4, change "Afi" to --$\Delta$fi--.

Column 4, line 49, change "12b" to --12d--.

Column 6, line 55, in "$x1_{(i)}$" do not bold the 1.

Column 6, line 66, in "$x1_{(i)}$" do not bold the 1.

Column 9, line 13, change "in" to --In--.

Column 11, line 13, change "AVAIFS" to --$\Delta V_{A/FS}$-- .

Column 12, line 15, change "It" to --it--.

Column 12, line 64, change "VA/FS(k)" to --$V_{A/FS}$(k)--.

Column 13, line 10, change "Akg(j)" to --$\Delta$kg(j)--.

Column 13, line 11, change "KG(J)" to --KG(j)--.

Column 13, line 15, change "...KG(J)..." to --...KG(j)...--

Column 13, line 29, change "If" to --if--.

Column 14, line 3, change "a" to --$\alpha$--.

UNITED STATES PATENT AND TRADEMARK OFFICE

CERTIFICATE OF CORRECTION

PATENT NO. : 5,752,492

DATED : May 19, 1998

INVENTOR(S) : Yoshihiko KATO, et al.

It is certified that error appears in the above-identified patent and that said Letters Patent is hereby corrected as shown below:

Column 14, line 18, change "fim(i)" to --$fim_{(i)}$--.

Column 14, line 34, change "fim(i)" to --$fim_{(i)}$--.

Column 15, line 11, change "nappens" to --happens--.

Column 15, line 29, change "fwm(i)" to --$fwm_{(i)}$--.

Column 15, line 37, change "$108_{(i)}$" to --108(i)--.

Signed and Sealed this

Twentieth Day of February, 2001

*Attest:*

Nicholas P. Godici

NICHOLAS P. GODICI

*Attesting Officer*

*Acting Director of the United States Patent and Trademark Office*